US010837071B2

(12) United States Patent
Ishibashi et al.

(10) Patent No.: US 10,837,071 B2
(45) Date of Patent: Nov. 17, 2020

(54) HOLLOW ELEMENT MANUFACTURING METHOD AND ROTARY MACHINE MANUFACTURING METHOD

(71) Applicant: MITSUBISHI HEAVY INDUSTRIES COMPRESSOR CORPORATION, Tokyo (JP)

(72) Inventors: Yusuke Ishibashi, Tokyo (JP); Shugo Iwasaki, Tokyo (JP); Shinichiro Tokuyama, Hiroshima (JP); Yuji Masuda, Hiroshima (JP); Kosei Kawahara, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 331 days.

(21) Appl. No.: 15/551,411

(22) PCT Filed: Oct. 16, 2015

(86) PCT No.: PCT/JP2015/079310
§ 371 (c)(1),
(2) Date: Aug. 16, 2017

(87) PCT Pub. No.: WO2016/132595
PCT Pub. Date: Aug. 25, 2016

(65) Prior Publication Data

US 2018/0030561 A1 Feb. 1, 2018

(30) Foreign Application Priority Data

Feb. 18, 2015 (JP) ..... 2015-029352

(51) Int. Cl.
*C21D 9/00* (2006.01)
*C21D 1/18* (2006.01)
(Continued)

(52) U.S. Cl.
CPC ..... *C21D 9/0068* (2013.01); *C21D 1/00* (2013.01); *C21D 1/18* (2013.01); *C21D 6/002* (2013.01);
(Continued)

(58) Field of Classification Search
None
See application file for complete search history.

(56) References Cited

U.S. PATENT DOCUMENTS 4,575,054 A * 3/1986 Kruppert ..... C21D 9/085 266/114
2001/0046439 A1 11/2001 Mariotti
(Continued)

FOREIGN PATENT DOCUMENTS

JP S63-310920 A 12/1988
JP 04371520 A * 12/1992
(Continued)

OTHER PUBLICATIONS

Machine translation of JPH04-371520A. (Year: 1992).*
(Continued)

*Primary Examiner* — Xiaowei Su
(74) *Attorney, Agent, or Firm* — Osha Bergman Watanabe & Burton LLP

(57) ABSTRACT

A method of manufacturing a hollow element which has an internal space and of which the internal space is cryogenically used, the method comprising a base material forming step of forming a base material which has a space to serve as the internal space; a filling step of filling the internal space of the formed base material with fluid having a temperature equal to or lower than a temperature at which the base material is subjected to solid-phase transformation and causing the base material to be subjected to the solid-phase transformation; and a finishing step of finishing the base
(Continued)

material after the base material is subjected to phase transformation.

9 Claims, 5 Drawing Sheets

(51) Int. Cl.

| | |
|---|---|
| ***C21D 1/00*** | (2006.01) |
| ***F04D 29/02*** | (2006.01) |
| ***F04D 29/42*** | (2006.01) |
| ***F04D 7/02*** | (2006.01) |
| ***C21D 6/00*** | (2006.01) |
| *F04D 1/06* | (2006.01) |
| *F04D 17/10* | (2006.01) |

(52) U.S. Cl.
CPC ..... *C21D 6/004* (2013.01); *C21D 9/00* (2013.01); *F04D 7/02* (2013.01); *F04D 29/026* (2013.01); *F04D 29/426* (2013.01); *F04D 29/4206* (2013.01); *C21D 2211/008* (2013.01); *F04D 1/063* (2013.01); *F04D 17/10* (2013.01); *F05D 2230/40* (2013.01)

(56) References Cited

U.S. PATENT DOCUMENTS

| | | | |
|---|---|---|---|
| 2015/0267559 | A1 | 9/2015 | Ishibashi et al. |
| 2015/0299862 | A1 | 10/2015 | Hoshikawa et al. |

FOREIGN PATENT DOCUMENTS

| | | | |
|---|---|---|---|
| JP | H06-145775 | A | 5/1994 |
| JP | H06-193598 | A | 7/1994 |
| JP | H10-060524 | A | 3/1998 |
| JP | 2000-178640 | A | 6/2000 |
| JP | 2002-005088 | A | 1/2002 |
| JP | 2005-264325 | A | 9/2005 |
| JP | 2007-146233 | A | 6/2007 |
| JP | 2008-163441 | A | 7/2008 |
| JP | 2013-014812 | A | 1/2013 |
| JP | 2014-129575 | A | 7/2014 |
| WO | 2014/103595 | A1 | 7/2014 |
| WO | 2014/104166 | A1 | 7/2014 |

OTHER PUBLICATIONS

International Search Report for corresponding International Application No. PCT/JP2015/079310, dated Dec. 22, 2015 (4 pages).
Written Opinion for corresponding International Application No. PCT/JP2015/079310, dated Dec. 22, 2015 (7 pages).

* cited by examiner

HOLLOW ELEMENT MANUFACTURING METHOD AND ROTARY MACHINE MANUFACTURING METHOD

TECHNICAL FIELD

The present invention relates to a method of manufacturing a hollow element having an internal space and a method of manufacturing a rotary machine.

Priority is claimed on Japanese Patent Application No. 2015-029352, filed Feb. 18, 2015, the content of which is incorporated herein by reference.

BACKGROUND ART

For example, a rotary machine such as a centrifugal compressor has a rotary shaft and a casing which covers a rotor such as a blade portion from an outer circumferential side. As the centrifugal compressor, for example, there is a centrifugal compressor which compresses liquefied natural gas and is used in a cryogenic environment (for example, at a temperature equal to or lower than −110° C.). The casing of such a centrifugal compressor is formed of 9% Ni steel or low temperature steel such as austenitic stainless steel (SUS 304 or the like).

It is known that when such low temperature steel is used in a cryogenic environment, solid-phase transformation (transformation of metal, and change in crystal structure, for example, transformation from retained austenite to martensite) is caused and results in a deformation. For example, in austenitic stainless steel, an unstable austenite phase transforms into martensite and results in volume expansion.

As treatment for restraining volume expansion, sub-zero treatment (deep cooling treatment) is known (for example, refer to Patent Document 1). In the sub-zero treatment, when a component is manufactured, a cryogenic state is intentionally provided so as to complete solid-phase transformation, and then, finishing is performed. Generally, the sub-zero treatment is performed by placing a component into a bath in which a cooling agent such as liquid nitrogen is input.

CITATION LIST

Patent Document

[Patent Document 1]

Japanese Unexamined Patent Application, First Publication No. 2007-146233

However, in a case where sub-zero treatment is performed with respect to a large-sized component such as a casing (for example, diameter of 1 m×length of 2 m) of a centrifugal compressor, since a bath having a large capacity is required, there are cases where equipment in the related art cannot cope therewith. In addition, there is a problem in that the quantity of liquid nitrogen for filling the bath having a large capacity also becomes massive.

SUMMARY OF INVENTION

One or more embodiments of the invention provide a method of manufacturing a hollow element, the method in which even a large base material can be easily subjected to solid-phase transformation, and a method of manufacturing a rotary machine.

According to a first aspect of the present invention, there is provided a method of manufacturing a hollow element which has an internal space and of which the internal space is cryogenically used. The method includes a base material forming step of forming a base material which has a space to serve as the internal space, a filling step of filling the internal space of the formed base material with fluid having a temperature equal to or lower than a temperature at which the base material is subjected to solid-phase transformation and causing the base material to be subjected to the solid-phase transformation; and a finishing step of finishing the base material after the base material is subjected to phase transformation.

According to one or more embodiments, even in a case of a large base material, the base material can be subjected to solid-phase transformation without immersing the base material in a bath filled with the fluid having the temperature equal to or lower than the temperature at which the base material is subjected to the solid-phase transformation.

In the method of manufacturing a hollow element, the hollow element may be configured to be assembled with a plurality of members. The method may further include a temporary assembling step of temporarily assembling each of the base materials respectively corresponding to the plurality of members which are formed through the base material forming step. The filling step may be carried out with respect to the temporarily assembled base material.

According to one or more embodiments, even though the hollow element is configured to be assembled with the plurality of members, the base material can be subjected to phase transformation.

In the method of manufacturing a hollow element, in the filling step, a core may be disposed in the internal space in a state of being separated from a surface defining the internal space, and a space between the core and the base material may be filled with the fluid.

According to one or more embodiments, since the volume of the internal space is reduced due to the core, the supply amount of the fluid can be reduced.

In the method of manufacturing a hollow element, an internal component assembled in the internal space of the hollow element may be used as the core.

According to the configuration, an assembling component to be assembled in the internal space of the hollow element can be subjected to phase transformation at the same time.

In the method of manufacturing a hollow element, in the filling step, a temperature of the surface defining the internal space may be measured and completion of the solid-phase transformation may be determined.

According to one or more embodiments, it is possible to determine whether or not the solid-phase transformation of the base material is completed, based on the temperature of the surface defining the internal space.

In the method of manufacturing a hollow element, in the filling step, a deformation of the base material may be measured and the completion of the solid-phase transformation may be determined.

According to one or more embodiments, it is possible to determine whether or not the solid-phase transformation of the base material is completed, when the dimensional change of the base material is settled.

In addition, according to a second aspect of the present invention, there is provided a method of manufacturing a rotary machine. The method includes a casing forming step of forming a casing by using the method of manufacturing a hollow element according to any one of those described above, and an assembling step of assembling the formed casing and an internal component.

According to one or more embodiments, even in a case of a casing of a large-sized rotary machine, the casing can be subjected to solid-phase transformation without immersing the base material of the casing in the bath filled with the fluid having the temperature equal to or lower than the temperature at which the base material of the casing is subjected to the solid-phase transformation.

According to one or more embodiments of the invention, even in a case of a large base material, the base material can be subjected to solid-phase transformation without immersing the base material in the bath filled with the fluid having the temperature equal to or lower than the temperature at which the base material is subjected to the solid-phase transformation.

DETAILED DESCRIPTION OF EMBODIMENTS

First Embodiment

Hereinafter, a method of manufacturing a centrifugal compressor 100 (rotary machine) according to a first embodiment of the present invention will be described.

The method of manufacturing the centrifugal compressor 100 of the present embodiment is a method in which treatment called sub-zero treatment (deep cooling treatment) is carried out with respect to a base material 8 of the casing 1 before the base material 8 is subjected to finishing, in a case of manufacturing the casing 1 configuring the centrifugal compressor 100 which is cryogenically used (for example, at a temperature equal to or lower than −110° C.), so that the dimensional change of a casing 1 when the centrifugal compressor 100 is in use is restrained.

That is, in the method, heat treatment is performed to cool the base material 8 of the casing 1 to a temperature, for example, equal to or lower than −110° C. so as to cause solid-phase transformation of metal configuring the base material 8 (transformation of metal, and change in crystal structure, for example, transformation from retained austenite to martensite).

The centrifugal compressor 100 manufactured in the present embodiment is an apparatus which takes fluid F in and raises the pressure of the fluid F by causing the fluid F to circulate along an axial line O.

Figure 1:
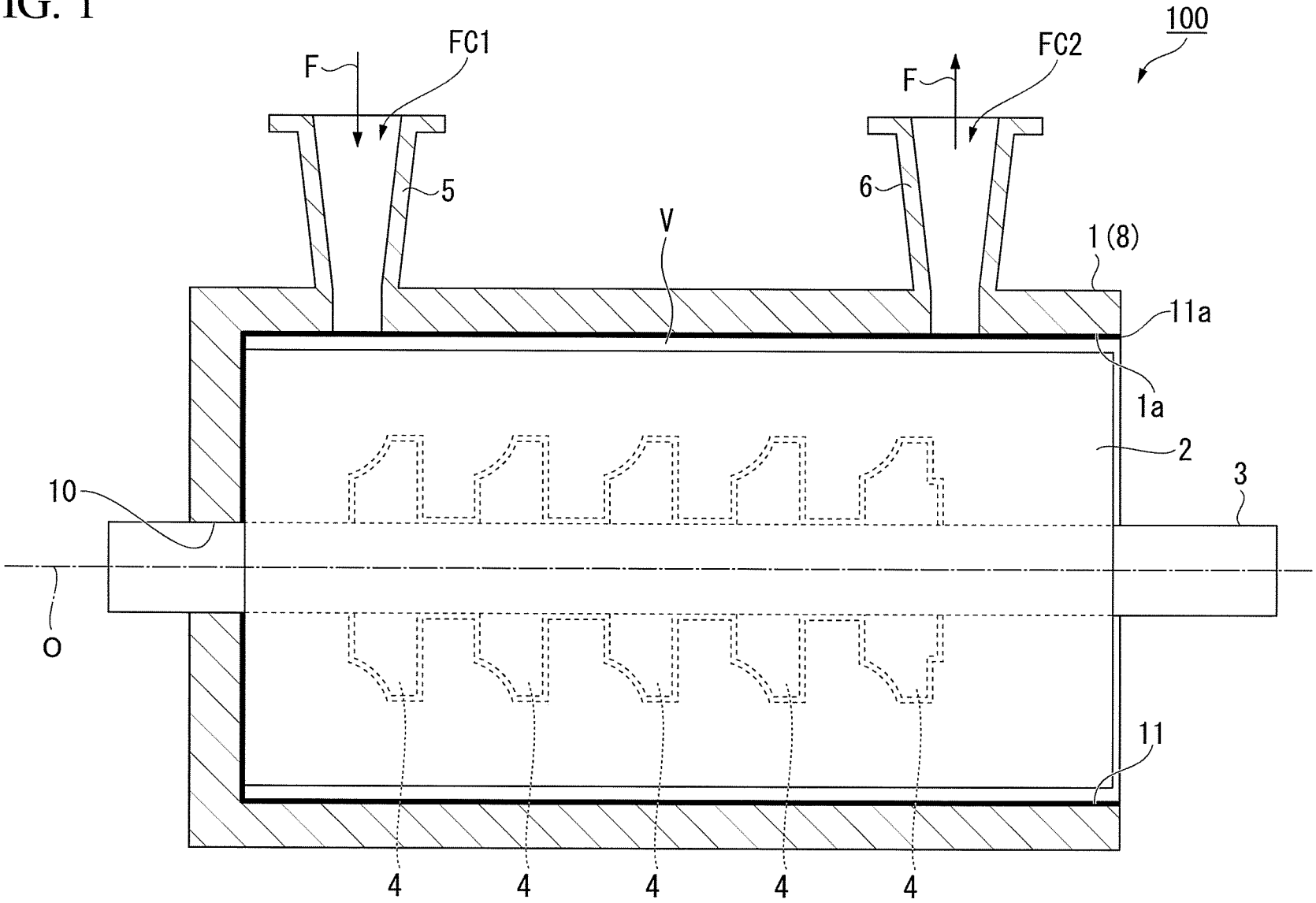
FIG. 1 is a schematic sectional view showing a centrifugal compressor manufactured through a method of manufacturing a centrifugal compressor of a first embodiment of the present invention.

As shown in FIG. 1, the centrifugal compressor 100 has a cylindrical casing 1, and a plurality of internal components 2, 3, 4 assembled inside the casing 1. The internal components may include an inner casing 2 which is covered with the casing 1 from the outer circumferential side and is provided so as to be non-rotatable relative to the casing 1, a rotary shaft 3 which is covered with the inner casing 2 from the outer circumferential side and is provided so as to be rotatable relative to the inner casing 2, and impellers 4. That is, the casing 1 is a hollow element having an internal space V in which the internal components 2, 3, 4 are assembled.

The rotary shaft 3 has a columnar shape centered on the axial line O and extends in a direction of the axial line O. In addition, the impellers 4 in a plurality of stages are externally fitted to the rotary shaft 3 at predetermined intervals in the direction of the axial line O. The impellers 4 rotate around the axial line O together with the rotary shaft 3.

The inner casing 2 supports the rotary shaft 3 and the impellers 4. In the inner casing 2, flow channels (not shown) are formed between the impellers 4. The fluid F circulates in stages from the first stage impeller 4 to the last stage impeller 4 via the flow channels, thereby raising the pressure.

The casing 1 has a cylindrical shape which is centered on the axial line O and in which an upstream-side opening portion 10 is formed on a first side of the axial line O (the left side of the page in FIG. 1) and a downstream-side opening portion 11 is formed on a side opposite to the first side. The casing 1 forms the external shape of the centrifugal compressor 100. In the present embodiment, an end portion of the casing 1 on one side of the axial line O has a shape annularly protruding radially inward along the axial line O. Accordingly, compared to the downstream-side opening portion 11, the upstream-side opening portion 10 has a small opening diameter.

Moreover, the casing 1 has an intake port 5 for the fluid F, the intake port 5 being provided at a first end portion which is the upstream side in the direction of the axial line O so as to protrude radially outward along the axial line O from the outer circumferential surface. The casing 1 has a discharge port 6 for the fluid F, the discharge port 6 being provided at a second end portion opposite to the first end portion. In the present embodiment, the casing 1 has no split surface. The casing 1 is formed of an integrated cylindrical member.

In the intake port 5, an intake flow channel FC1 penetrating the casing 1 radially along the axial line O is formed such that the inside and the outside of the casing 1 communicate with each other. The intake flow channel FC1 communicates with the inside of the first stage impeller 4 and takes in the fluid F from the outside such that the fluid F can flow into the impeller 4.

Similarly, in the discharge port 6, a discharge flow channel FC2 penetrating the casing 1 radially along the axial line O is formed such that the inside and the outside of the casing 1 communicate with each other. In addition, the discharge flow channel FC2 communicates with the inside of the last stage impeller 4, and the fluid F can be discharged from the impeller 4 to the outside.

Next, regarding the method of manufacturing the centrifugal compressor 100, an overview of manufacturing steps will be described first. Thereafter, each of the steps will be described in detail.

Figure 2:
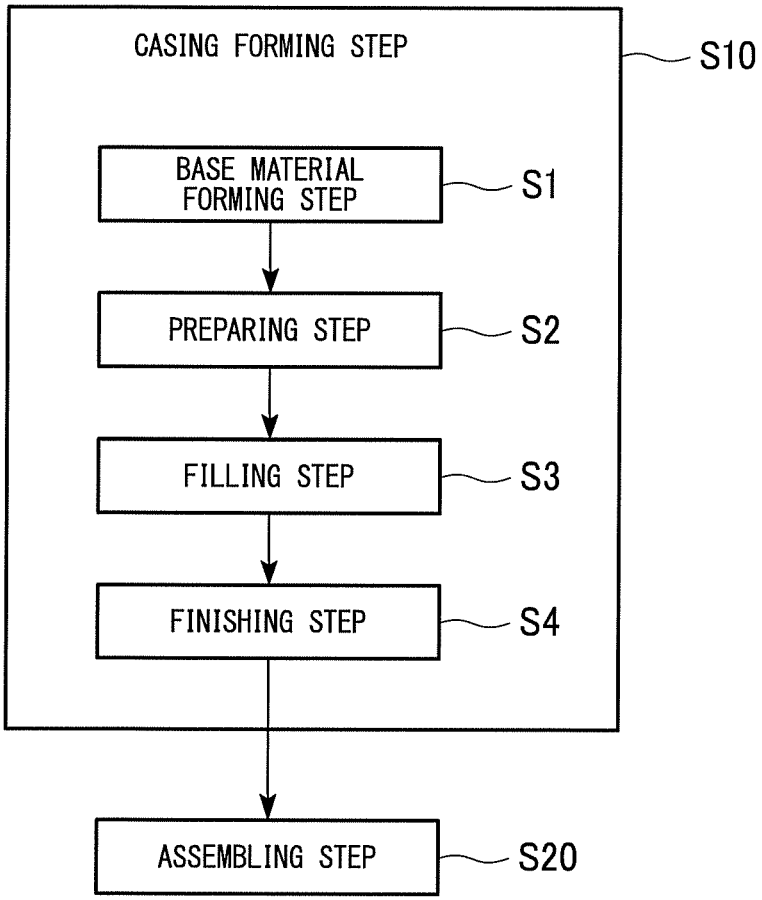
FIG. 2 is a flow chart showing a procedure of the method of manufacturing a centrifugal compressor of the first embodiment of the present invention.

As shown in FIG. 2, the method of manufacturing the centrifugal compressor 100 may include a casing forming step S10 of forming the casing 1 by finishing (machining) the base material 8 of the casing 1, and an assembling step S20 of assembling the formed casing 1 and the internal components 2, 3, 4.

The casing forming step S10 may include a base material forming step S1 of forming the base material 8 which has a space to serve as the internal space V, a preparing step S2 of preparing the sub-zero treatment for the base material 8, a filling step S3 of filling the internal space V with liquid nitrogen L (refer to FIG. 3) and causing the base material 8 to be subjected to solid-phase transformation, and a finishing step S4 of finishing the base material 8 after the base material 8 is subjected to solid-phase transformation.

First, the casing forming step S10 will be described.

First, when the casing 1 is formed, the base material forming step S1 which is a step of forming the base material 8 of the casing 1 having the space to serve as the internal space V is carried out.

For example, the base material 8 can be formed through casting. In the base material forming step S1, after the material is heated to a temperature higher than the melting point thereof and is liquefied, the liquefied material is cast into a mold and is cooled, so that the base material 8 is formed.

The formed base material 8 is subjected to finishing (will be described below), and a casting surface of the base material 8 (surface of the cast) is machined, thereby forming the casing 1. In the base material 8, the intake port 5, the discharge port 6, the upstream-side opening portion 10, and the downstream-side opening portion 11 are formed. The base material 8 has the internal space V which is a space in which the internal components 2, 3, 4 are assembled.

That is, the base material 8 internally has a space and is installed such that the direction of the axial line O coincides with the vertical direction. The base material 8 has a shape which can internally store fluid when the intake port 5, the discharge port 6, and the upstream-side opening portion 10 are blocked or the like. Due to such a shape, when the internal space V is filled with liquid, a surface defining the internal space V and the liquid can be in contact with each other.

In the present embodiment, as the base material 8, austenitic stainless steel (for example, SUS 304, 18 Cr-8 Ni, 18 chromium stainless) is used. The material for forming the base material 8 is not limited to the austenitic stainless steel. It is possible to use a material, for example, 9% Ni steel having little deterioration in mechanical strength such as toughness even in a cryogenic environment (for example, at a temperature equal to or lower than −110° C.).

Figure 3:
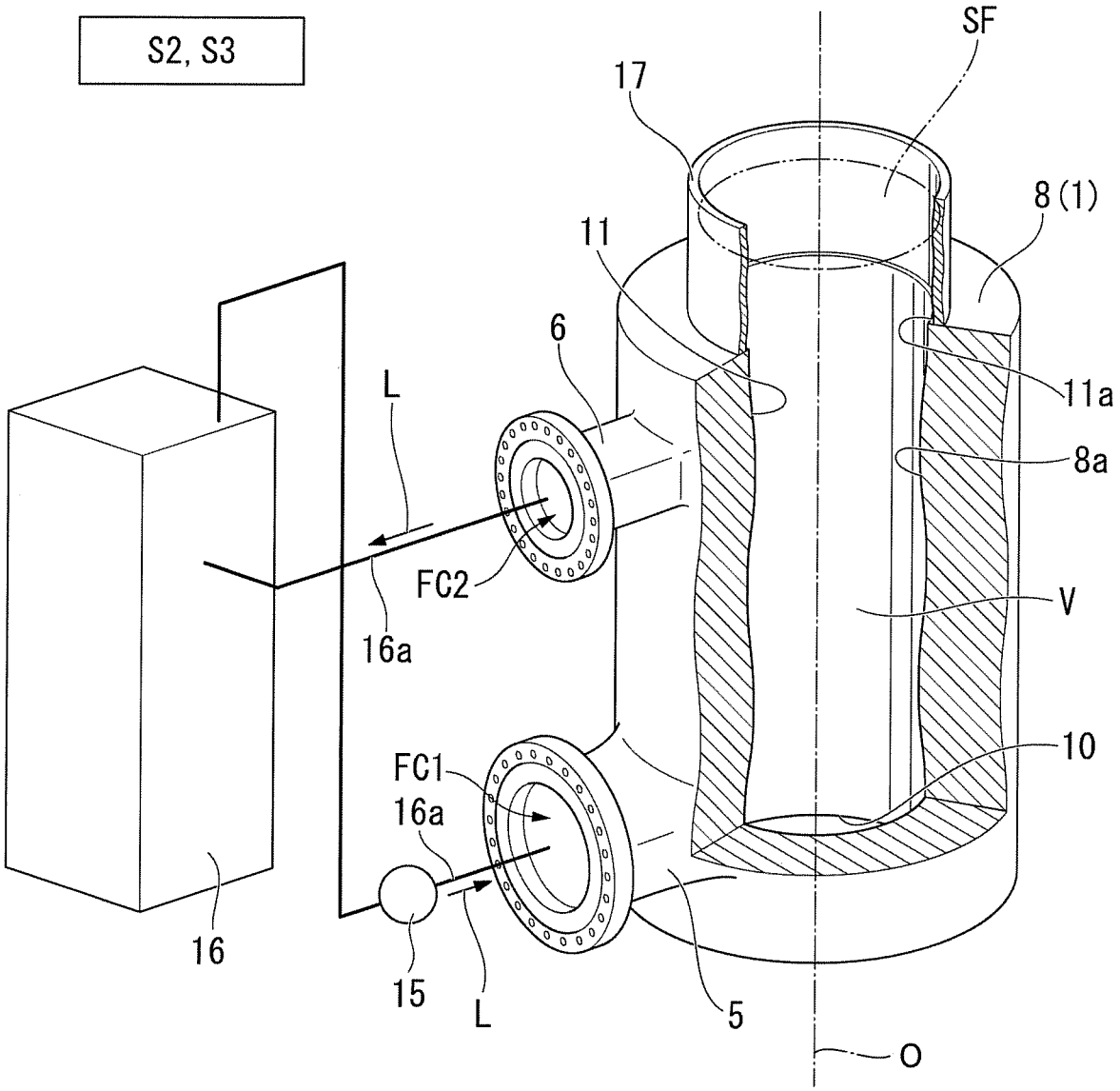
FIG. 3 is a perspective view which relates to the method of manufacturing a centrifugal compressor of the first embodiment of the present invention and shows a state where liquid nitrogen is introduced into a base material of a casing.

Next, the preparing step S2 is carried out. As shown in FIG. 3, the base material 8 is mounted such that the direction of the axial line O coincides with the vertical direction, and the intake port 5 is disposed at a lower side. At this point in time, since the base material 8 is mounted such that the downstream-side opening portion 11 faces upward, the largest opening portion among the intake port 5, the discharge port 6, the upstream-side opening portion 10, and the downstream-side opening portion 11 which are all the opening portions in the base material 8 is in a state of facing upward.

In the preparing step S2, a lid is put on the upstream-side opening portion 10, so that fluid is prevented from leaking through the upstream-side opening portion 10. Moreover, a pump 15 and a tank 16 (refer to FIG. 3) are installed, and piping 16*a* is connected to the intake port 5 and the discharge port 6.

Moreover, a cylindrical cover member 17 surrounds an opening edge portion 11*a* of the downstream-side opening portion 11 from the outer circumferential side such that the downstream-side opening portion 11 which opens upward is further extended upward. The cover member 17 forms a space for accumulating liquid, at an upper portion of the downstream-side opening portion 11. The cover member 17 is attached to an upper portion of the base material 8. The cover member 17 may be fixed to the upper portion of the base material 8. However, the cover member 17 may only be simply mounted in the upper portion of the base material 8 via a gasket or the like.

Next, the filling step S3 is carried out.

As shown in FIG. 3, in the filling step S3, the internal space V is filled with the liquid nitrogen L which is fluid (coolant) having a temperature equal to or lower than a temperature at which the base material 8 is subjected to solid-phase transformation, and the base material 8 is subjected to the solid-phase transformation. The coolant is not limited to the liquid nitrogen L. For example, any coolant is acceptable as long as the base material 8 can be cooled to approximately −110° C. when the base material 8 is in contact with the coolant. In addition, the coolant is not limited to liquid. Gas may be used.

In the filling step S3, the liquid nitrogen L is supplied through the intake port 5 from the tank 16 by using the pump 15, and the inside of the casing 1 is filled with the liquid nitrogen L. At this time, it is possible that the supply amount of the liquid nitrogen L be determined such that a liquid level SF of the stored liquid nitrogen L is positioned inside the cover member 17 or overflows the cover member 17, so that the liquid level SF is in the upper portion of the downstream-side opening portion 11. Thereafter, the liquid nitrogen L is discharged through the discharge port 6 of the base material 8 and is collected in the tank 16. Thereby, an inner surface 8*a* of the base material 8 (surface defining the internal space V) is cooled.

At this time, the temperature of the inner surface 8*a* of the base material 8 is measured by using a temperature measuring device such as a thermocouple (not shown). The temperature of the inner surface 8*a* is checked through a monitor (not shown) connected to the thermocouple.

In addition, it is possible that a lagging material (heat insulating material, not shown) be wound around the outer surface of the base material 8 such that heat outside the base material 8 is restrained from being transferred to the base material 8. As the lagging material, for example, it is possible to employ a fibrous heat insulating material such as glass wool, or a foamed heat insulating material such as urethane foam. Accordingly, the base material 8 can be more efficiently cooled.

When the temperature displayed on the monitor reaches a target temperature (for example, −110° C.), the filling step S3 ends.

Accordingly, the base material 8 formed of austenitic stainless steel is subjected to the sub-zero treatment (deep cooling treatment, super sub-zero treatment). That is, in the base material 8 formed of austenitic stainless steel, transformation from retained austenite to martensite is caused.

Next, the finishing step S4 is carried out. In the finishing step S4, the casting surface of the base material 8 subjected to the sub-zero treatment is mainly machined, and the casing 1 of the centrifugal compressor 100 is manufactured. Accordingly, the casing forming step S10 is completed.

Subsequently, an assembling step of assembling the internal components 2, 3, 4 in the internal space V of the casing 1 is carried out.

According to the embodiment, even in a case of a large base material 8, the base material 8 can be subjected to solid-phase transformation without immersing the base material 8 in a bath filled with the liquid nitrogen L. That is, sub-zero treatment can be more easily performed with respect to a large member.

That is, even in a case of the casing 1 of the large-sized centrifugal compressor 100, the casing 1 can be subjected to solid-phase transformation without immersing the base material 8 of the casing 1 in the bath filled with the liquid nitrogen L.

In addition, when the temperature of the surface 8*a* defining the internal space V is measured, it is possible to determine whether or not the solid-phase transformation of the base material 8 is completed.

Second Embodiment

Next, a method of manufacturing a centrifugal compressor 100 according to a second embodiment of the present invention will be described.

The same reference sign will be applied to a configuration component in common with the first embodiment, and a detailed description thereof will not be repeated.

In the present embodiment, when the filling step S3 is performed, in a state where a columnar core 31 is coaxially disposed with the base material 8 in the internal space V of the base material 8, that is, the central axis of the core 31 coincides with the axial line O, and in a state where the core 31 is provided by being inserted through the downstream-side opening portion 11 in a state of being separated from the surface 8*a* defining the internal space V of the base material 8, filling is performed with the liquid nitrogen L.

Figure 4:
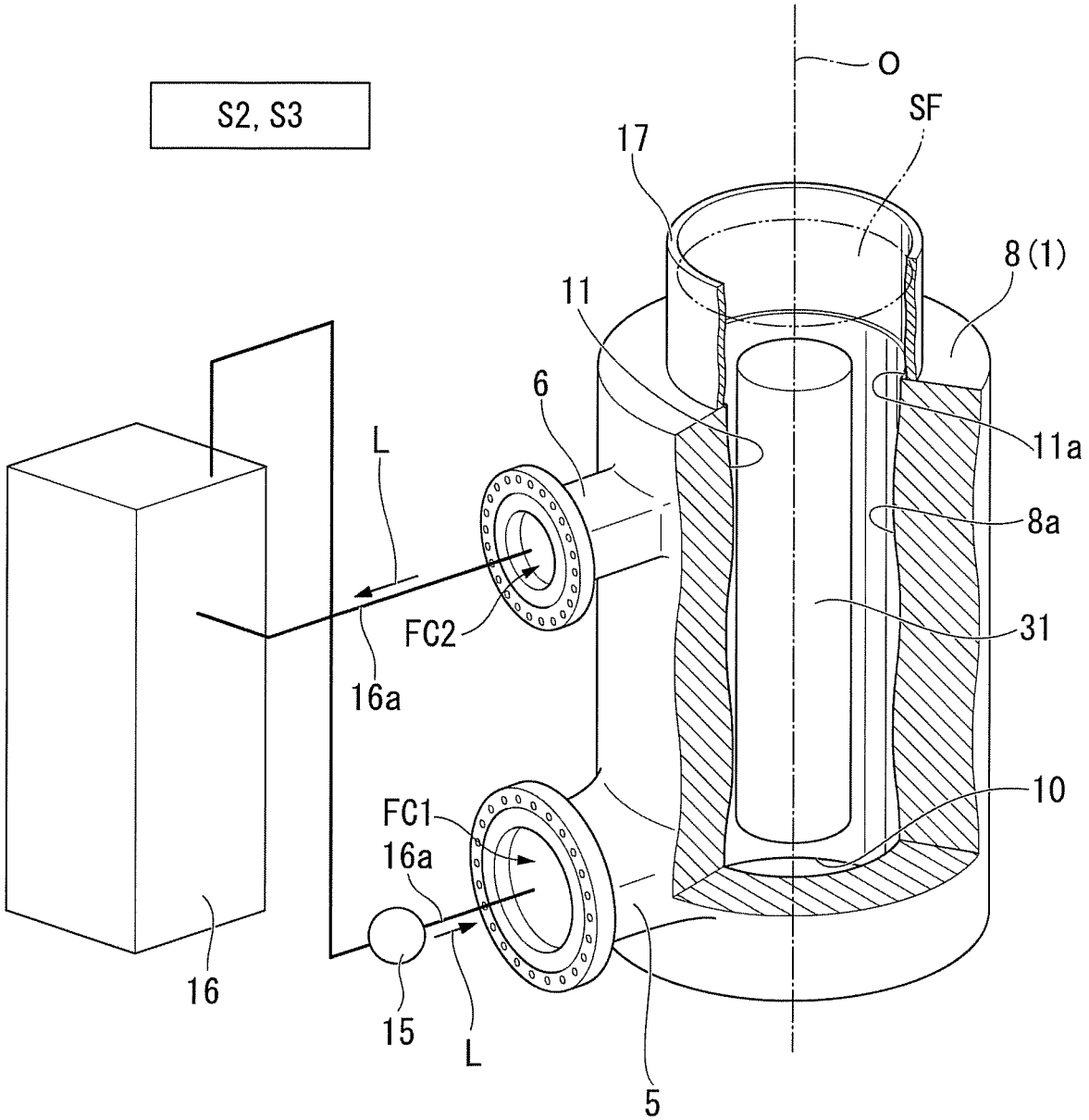
FIG. 4 is a perspective view which relates to a method of manufacturing a centrifugal compressor of a second embodiment of the present invention and shows a state where liquid nitrogen is introduced into a base material of a casing.

As shown in FIG. 4, in the filling step S3, a heat insulating core 31 is installed. As the core 31, it is possible to use a material having low heat conductivity such as plastic, for example, polyacetal resin (POM). That is, it is possible to employ a material in which the temperature of the liquid nitrogen L is unlikely to be transferred and the temperature of the liquid nitrogen L is unlikely to rise.

Due to a predetermined support member (not shown), the core 31 is installed in the center of the internal space V. When the core 31 is installed in the internal space V, the quantity of the liquid nitrogen L filling the internal space V decreases.

In addition, as the core 31, a material such as metal having high heat conductivity may be used. In this case, the temperature of the liquid nitrogen L can be restrained from rising due to the core 31 by using the core 31 which has been subjected to the sub-zero treatment such that the temperature is lowered. That is, the core 31 may be configured to be cooled in advance.

According to the method of manufacturing the centrifugal compressor 100 of the present embodiment, when the core 31 is inserted, the volume of the internal space V can be reduced. Therefore, a supply amount of plating liquid W3 can be reduced, leading to cost reduction.

The core 31 is not necessarily provided in a coaxial manner. When the core 31 is provided such that at least the volume of the space inside the casing 1 is reduced, the supply amount of the liquid nitrogen L can be reduced and cost reduction can be achieved.

Modification Example

In the above-described embodiment, the core 31 is disposed in the internal space V of the base material 8. However, in place of the core 31, at least one of the internal components 2, 3, 4 to be assembled in the casing 1 may be disposed in the internal space V. At this time, it is possible to perform the disposition in a state where the internal components 2, 3, 4 are assembled. That is, the base material 8 having the internal space V may be used as a bath for the liquid nitrogen L.

Accordingly, as long as a component has a size which can be accommodated in the internal space V, the component can be subjected to the sub-zero treatment together with the base material 8.

Third Embodiment

Next, a method of manufacturing a centrifugal compressor according to a third embodiment of the present invention will be described.

In the present embodiment, in the filling step S3, a deformation of the base material 8 is monitored.

At this time, a deformation of the inner surface 8*a* of the base material 8 is measured by using a deformation measuring sensor (not shown) such as a strain gauge. The dimensional change of the inner surface 8*a* is checked through a monitor (not shown) connected to the strain gauge.

The filling step S3 is completed at this point in time when the dimensional change is settled.

According to the embodiment, it is possible to determine whether or not the solid-phase transformation of the base material 8 is completed, when the dimensional change of the base material 8 is settled.

Fourth Embodiment

Next, a method of manufacturing a centrifugal compressor according to a fourth embodiment of the present invention will be described.

In the present embodiment, a casing 1A to be subjected to the sub-zero treatment is different from the casings in the first embodiment to the third embodiment.

Figure 5:
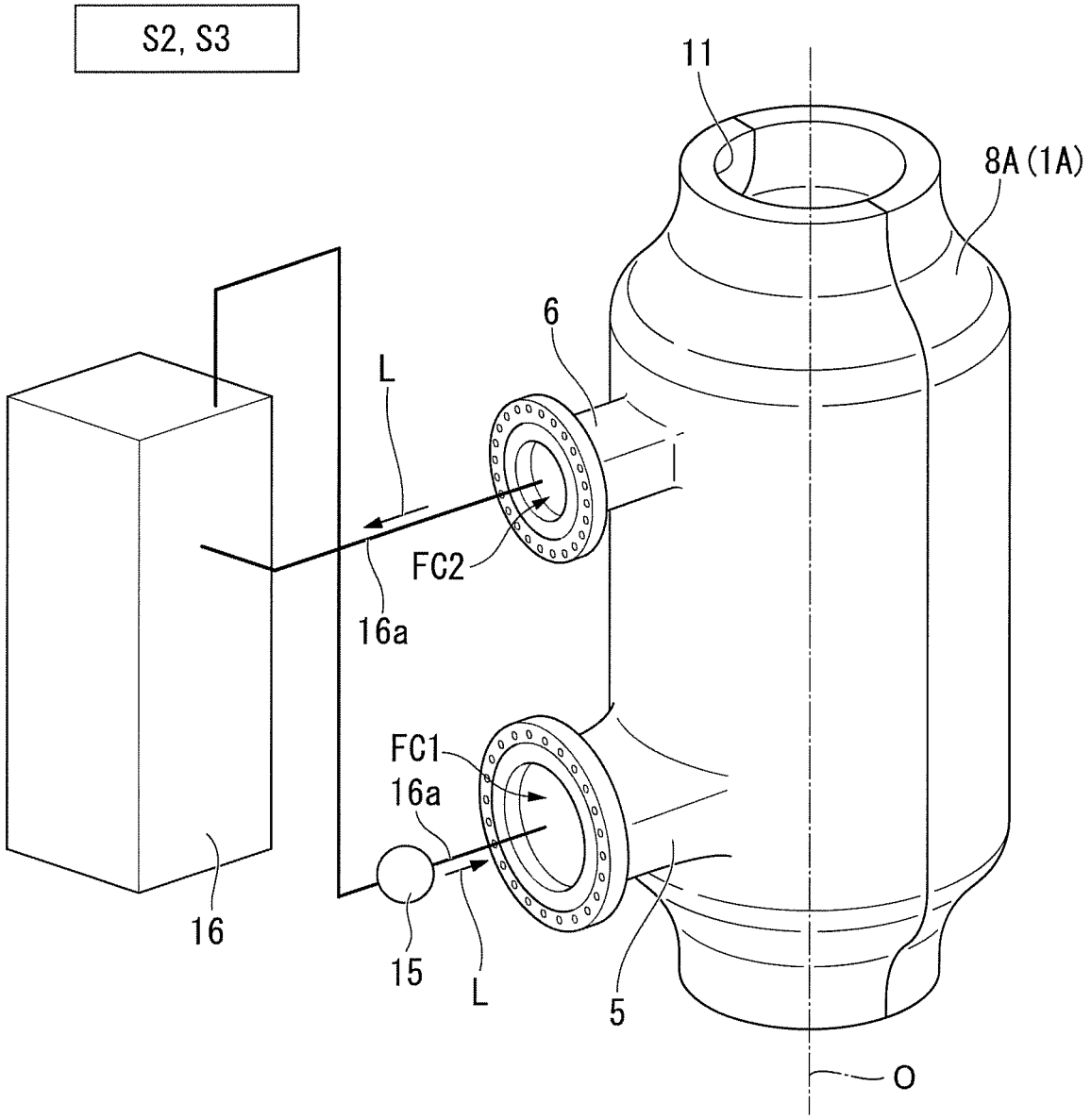
FIG. 5 is a perspective view which relates to a method of manufacturing a centrifugal compressor of a fourth embodiment of the present invention and shows a state where liquid nitrogen is introduced into a base material of a casing.

As shown in FIG. 5, the casing 1A of the present embodiment is a horizontal split-type casing split into two so as to include the axial line O. That is, a base material 8A of the casing 1A, which is a hollow element of the present embodiment, is configured to be assembled with a plurality of members.

In the method of manufacturing a centrifugal compressor of the present embodiment, in the base material forming step S1, the base materials 8A respectively corresponding to the plurality of members configuring the casing 1A are formed.

The method of manufacturing a centrifugal compressor of the present embodiment includes a temporary assembling step of temporarily assembling each of the base materials 8A between the base material forming step S1 and the preparing step S2. The filling step S3 is carried out with respect to the temporarily assembled base material 8A.

According to the embodiment, even though the base material 8A, which is the hollow element, configuring the casing 1A is configured to be assembled with the plurality of members, the base material 8A can be subjected to phase transformation.

Hereinabove, the embodiments of the present invention have been described in detail. However, some design changes can be made within a scope not departing from the technical idea of the present invention.

In the embodiments described above, descriptions have been given regarding the centrifugal compressor. However, the above-described manufacturing method can also be applied to other rotary machines such as an axial compressor and a turbine.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1, 1A Casing (Hollow element)
2 Inner casing
3 Rotary shaft
4 Impeller
5 Intake port
6 Discharge port
8, 8A Base material
8*a* Surface
10 Upstream-side opening portion
11 Downstream-side opening portion
15 Pump
16 Tank
16*a* Piping
17 Cover member
31 Core
100 Centrifugal compressor
S1 Base material forming step
S2 Preparing step
S3 Filling step
S4 Finishing step
S10 Casing forming step
S20 Assembling step
L Liquid nitrogen (Fluid)
V Internal space

The invention claimed is:

1. A method of manufacturing a hollow element which has an internal space and of which the internal space is cryogenically used, the method comprising:

a base material forming step of forming a base material which has a space to serve as the internal space;

a filling step of filling the internal space of the formed base material with fluid through a piping connected to the base material, wherein the fluid is liquid nitrogen and has a temperature equal to or lower than a temperature at which the base material is subjected to solid-phase transformation and causes the base material to be subjected to the solid-phase transformation; and a finishing step of finishing the base material to manufacture a hollow element which has an internal space and of which the internal space is cryogenically used after the base material is subjected to the solid-phase transformation.

2. The method of manufacturing a hollow element according to claim 1, wherein the hollow element is assembled with a plurality of members, wherein the method further comprises:

a preliminary assembling step of preliminary assembling each of the base materials respectively corresponding to the plurality of members which are formed through the base material forming step, and wherein the filling step is carried out with respect to the preliminary assembled base material.

3. The method of manufacturing a hollow element according to claim 1, wherein in the filling step, a core is disposed in the internal space in a state of being separated from a surface defining the internal space, and a space between the core and the base material is filled with the fluid.

4. The method of manufacturing a hollow element according to claim 3, wherein an internal component assembled in the internal space of the hollow element is used as the core.

5. The method of manufacturing a hollow element according to claim 1, wherein in the filling step, a temperature of the surface defining the internal space is measured and completion of the solid-phase transformation is determined.

6. The method of manufacturing a hollow element according to claim 1, wherein in the filling step, a deformation of the base material is measured and the completion of the solid-phase transformation is determined.

7. A method of manufacturing a rotary machine, the method comprising:

forming a hollow element using the method of manufacturing a hollow element according to claim 1; and assembling the hollow element and an internal component.

8. The method of manufacturing a hollow element according to claim 1, wherein in the filling step the fluid is supplied from a tank that is connected to the piping.

9. The method of manufacturing a hollow element according to claim 1, wherein in the filling step a sub-zero treatment is carried out with the fluid in which the base material is cooled to a temperature equal to or lower than −110° C. and subjected to solid-phase transformation.

* * * * *